United States Patent [19]

Raven et al.

[11] Patent Number: 4,745,553

[45] Date of Patent: May 17, 1988

[54] METHOD AND APPARATUS FOR OPTIMIZING THE OPERATION CHARACTERISTICS OF AN ENGINE

[75] Inventors: Elizabeth A. Raven; Henry P. Tyler, both of South Bend, Ind.; Francis G. Sollman, Jacksonville, Fla.

[73] Assignee: Allied Corporation, Morristown, N.J.

[21] Appl. No.: 685,626

[22] Filed: Dec. 24, 1984

[51] Int. Cl.[4] ..... F02D 37/00

[52] U.S. Cl. ..... 364/431.05; 364/431.04; 123/419; 123/436

[58] Field of Search ..... 364/431.04, 431.05; 123/416, 419, 425, 436

[56] References Cited

U.S. PATENT DOCUMENTS

| | | | |
|---|---|---|---|
| 4,225,925 | 9/1980 | Hattori et al. | 364/431.04 |
| 4,322,800 | 3/1982 | Hisegawa et al. | 123/419 |
| 4,403,584 | 9/1983 | Suzuki et al. | 364/431.05 |
| 4,428,342 | 1/1984 | Suzuki et al. | 123/436 |
| 4,442,815 | 4/1984 | Ninomiya | 123/436 |
| 4,478,185 | 10/1984 | Obayashi et al. | 364/431.05 |
| 4,487,186 | 12/1984 | Wahl et al. | 123/419 |
| 4,489,690 | 12/1984 | Burkel et al. | 123/419 |

*Primary Examiner*—Parshotam S. Lall

*Attorney, Agent, or Firm*—Ronald D. Welch; Ken C. Decker

[57] ABSTRACT

An engine control method and apparatus for optimizing an operating condition of an engine. A plurality of engine variables are determined and operated upon to direct the control of engine effectors so as to place the engine in an optimum operating condition. In particular, the engine effectors are controlled to minimize the fuel consumption of an engine operating at a steady-state. The system selectively moves a pair of engine effectors so as to determine the sensitivity of the engine variables to changes in effector outputs. Such sensitivities are updated during the system operation. The engine effectors are selectively moved as a function of the engine variable sensitivities in a direction to minimize fuel consumption without violating any predetermined operating limits of the engine variables. Once an optimum operating point is obtained, the system remains at rest and checks for changes in operating conditions that may require a new optimum to be determined.

15 Claims, 9 Drawing Sheets

500

502

$$
\begin{bmatrix}
0 & 0 & 0 & 0 & 0 & 0 & -1 \\
\frac{\Delta s \text{ s.a.}}{\Delta s \text{ s.a.t.}} & \frac{\Delta s \text{ s.a.}}{\Delta s \text{ m.p.t.}} & -1 & 0 & 0 & 0 & 0 \\
\frac{\Delta s \text{ d.k.l.}}{\Delta s \text{ s.a.t.}} & \frac{\Delta s \text{ d.k.l.}}{\Delta s \text{ m.p.t.}} & 0 & -1 & 0 & 0 & 0 \\
\frac{\Delta s \text{ a.p.}}{\Delta s \text{ s.a.t.}} & \frac{\Delta s \text{ a.p.}}{\Delta s \text{ m.p.t.}} & 0 & 0 & -1 & 0 & 0 \\
\frac{\Delta s \text{ m.p.}}{\Delta s \text{ s.a.t.}} & \frac{\Delta s \text{ m.p.}}{\Delta s \text{ m.p.t.}} & 0 & 0 & 0 & -1 & 0 \\
\frac{\Delta s \text{ BSFC}}{\Delta s \text{ s.a.t.}} & \frac{\Delta s \text{ BSFC}}{\Delta s \text{ m.p.t.}} & 0 & 0 & 0 & 0 & -1
\end{bmatrix}
\begin{bmatrix}
\Delta d \text{ s.a.t.} \\
\Delta d \text{ m.p.t.} \\
\Delta d \text{ s.a.} \\
\Delta d \text{ d.k.l.} \\
\Delta d \text{ a.p.} \\
\Delta d \text{ m.p.} \\
\Delta d \text{ BSFC}
\end{bmatrix}
=
\begin{bmatrix}
\text{VALUE} \\
0 \\
0 \\
0 \\
0 \\
0
\end{bmatrix}
$$

FIG. 13

METHOD AND APPARATUS FOR OPTIMIZING THE OPERATION CHARACTERISTICS OF AN ENGINE

BACKGROUND OF THE INVENTION

The present invention relates to a method and apparatus for optimizing the operating characteristics of an engine. In particular, the invention relates to a method and apparatus for minimizing the specific fuel consumption of a reciprocating piston engine.

Engine control systems that detect and control various engine operating characteristics in a closed-loop are known. Such engine control systems may include a central processing unit, such as a microprocessor, whereby various engine sensors associated with the engine are read and various engine effectors are controlled in accordance with closed-loop control laws or equations. Such engine control systems may include the capability of optimizing various engine operating characteristics. However, such optimization techniques require that the optimum operating characteristics be predetermined. Such a system automatically controls various engine variables in accordance with predetermined control laws in an effort to obtain these predetermined optimum conditions.

A disadvantage of the above-described system is that the optimum operating conditions may vary depending upon the instantaneous operating characteristics of the engine. That is, the control laws for moving the engine effectors as a function of the control system inputs are unable to be effectively altered as a function of the various changes in the engine operating characteristics, thus resulting in inefficient and inaccurate optimization.

An optimum control method for an internal combustion engine is disclosed in U.S. Pat. No. 4,322,800. The patent discloses a method for controlling an engine such that the engine is operated at a minimum rate of fuel consumption. At least one engine control variable is arranged in the form of a map with respect to various engine operating conditions and this mapped engine control variable is changed to compensate for variation in the engine operating conditions. However, such system does not consider if the engine variables have limited operating ranges and thus does not consider if the variables are driven outside their ranges during minimization. Moreover, the changes made to the map are permanent.

SUMMARY OF THE INVENTION

The present invention provides for a novel method and apparatus for optimizing at least one of a plurality of engine variables. The present invention provides for monitoring and detecting a plurality of engine variables, such as air manifold temperature, air manifold pressure, spark advance angle, etc., and determining the sensitivity of these variables to movements of various engine effectors. By determining the sensitivities of the various engine variables, and by knowing the operating limits of the engine variables, the control system determines the magnitude and direction of movement of the engine effectors so as to minimize one of the engine variables, preferably the specific fuel consumption.

The optimization method and apparatus of the present invention periodically updates the engine variable sensitivities and incrementally directs the movement of the engine effectors as a function of these sensitivities so as to minimize the specific fuel consumption. The optimization system may be an adjunct of a closed-loop control system and may provide the calculated trim, or movement, values to the closed-loop control system, the latter of which performs the necessary effector movements in accordance with known closed-loop control laws.

The present invention determines the sensitivities of the various engine variables by directing the movements of an engine effector about a starting point, and sampling the values of each engine variable following such movements. The amount of change of each variable per change in effector movement (i.e., the sensitivity of each variable) is thus determined. The system then determines, by an iterative technique, the magnitude and direction that the engine effectors can be moved, as a function of the engine sensitivities obtained, so that the fuel consumption of the engine can be minimized. This process is continually repeated until no further improvement in fuel consumption can be obtained. The engine then remains in this optimum condition until one of the engine variables has drifted to a condition outside of its predetermined operating limit, or until engine conditions have changed to a point that a new optimum condition is desired to be obtained.

Thus, it is an object of the present invention to control the operating characteristics of an engine so that one of a plurality of engine variables is placed in an optimum condition. The method and apparatus of the present invention directs the movement of various engine effectors until the optimum operating condition is obtained.

It is a further object of the present invention to direct the movement of the engine effectors as a function of the sensitivities of the engine variables. The method and apparatus of the present invention calculates the sensitivities of the engine variables and periodically updates the calculation following each movement of the effectors in a direction to optimize an engine variable.

Still further, it is an object of the present invention to direct the movement of the engine effectors so as to optimize an engine operating condition without violating any predetermined operating limits of the engine variables. In the event that an operating limit is exceeded, the system directs the movement of the engine effectors to a condition previously determined to be within limits.

BRIEF DESCRIPTION OF THE DRAWINGS

FIG. 13 is a representation of the simplex matrix equation.

DESCRIPTION OF THE PREFERRED EMBODIMENT

Figure 1:
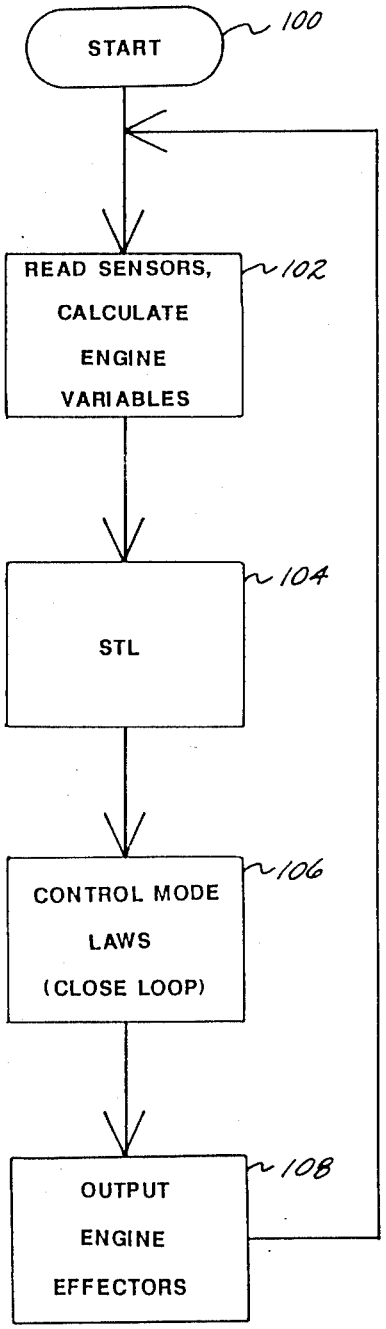
FIG. 1 is a functional flow chart of the overall operating characteristics of the present invention.

A functional flow chart of the overall operating characteristics of an engine control system, including the optimization method and apparatus of the present invention, is depicted in FIG. 1. The engine control system reads or detects various outputs of engine sensors and determines various engine variables that will be operated upon by the optimization portion of the control system (block 102). The various engine variables are provided to the optimization system, or the supervisory trim logic (STL) system (block 104). As will be described hereinbelow, the supervisory trim logic system optimizes one of the plurality of engine variables. In the preferred embodiment, the supervisory trim logic optimizes the fuel consumption of the engine, in particular the brake specific fuel consumption (BSFC) by minimizing the BSFC value. That is, the supervisory trim logic 104 determines how the engine is to be controlled so that the BSFC is minimized. The engine is controlled in accordance with conventional closed-loop control mode laws (block 106) wherein the STL supplements or trims the control loop values to move various engine effectors. The engine effectors are moved accordingly (block 108) and the system loops back on itself to continue to monitor the engine conditions.

Microprocessor-based engine control systems are known in the art. Such engine control systems include a reading of various engine sensors, calculating various engine variables, and operating upon such variables to control various engine effectors in accordance with the specific control-loop laws or equations programmed in the microprocessor-based system. The supervisory trim logic system 104 of the present invention supplements (or trims) the various inputs to the closed-loop control system so that the engine effectors are controlled to place the engine in an operating condition whereby at least one of the engine variables is optimized. Thus, the supervisory trim logic 104 of the present invention has application to any closed loop engine control system including engine controllers for reciprocating engines and turbine engines. In the specific embodiment discussed hereinbelow, the supervisory trim logic will be described with reference to a reciprocating engine wherein the BSFC is to be minimized. The minimization of the BSFC is accomplished by controlling the spark advance angle before top dead center and the air manifold pressure. That is, the spark advance angle and the air manifold pressure are selectively controlled in accordance with closed-loop engine control mode laws 106 supplemented by supervisory trim logic signals (from 104), in a manner that minimizes the fuel consumption of the engine. This minimization of fuel consumption occurs without violating any of the predetermined operating limits of the various engine variables.

The optimizing method and apparatus of the present invention has particular applicability to the control of reciprocating piston engines that are intended to operate at a steady-state (constant RPM) level. For example, the present invention can be effectively employed to control relatively large four-stroke turbocharged/turbocooled engines (such as the Cooper Bessemer LSV-16 engine) employed to drive centrifugal compressers that pump methane gas through a gas pipeline. Such an engine may deliver up to 4200 brake horsepower.

Figure 2:
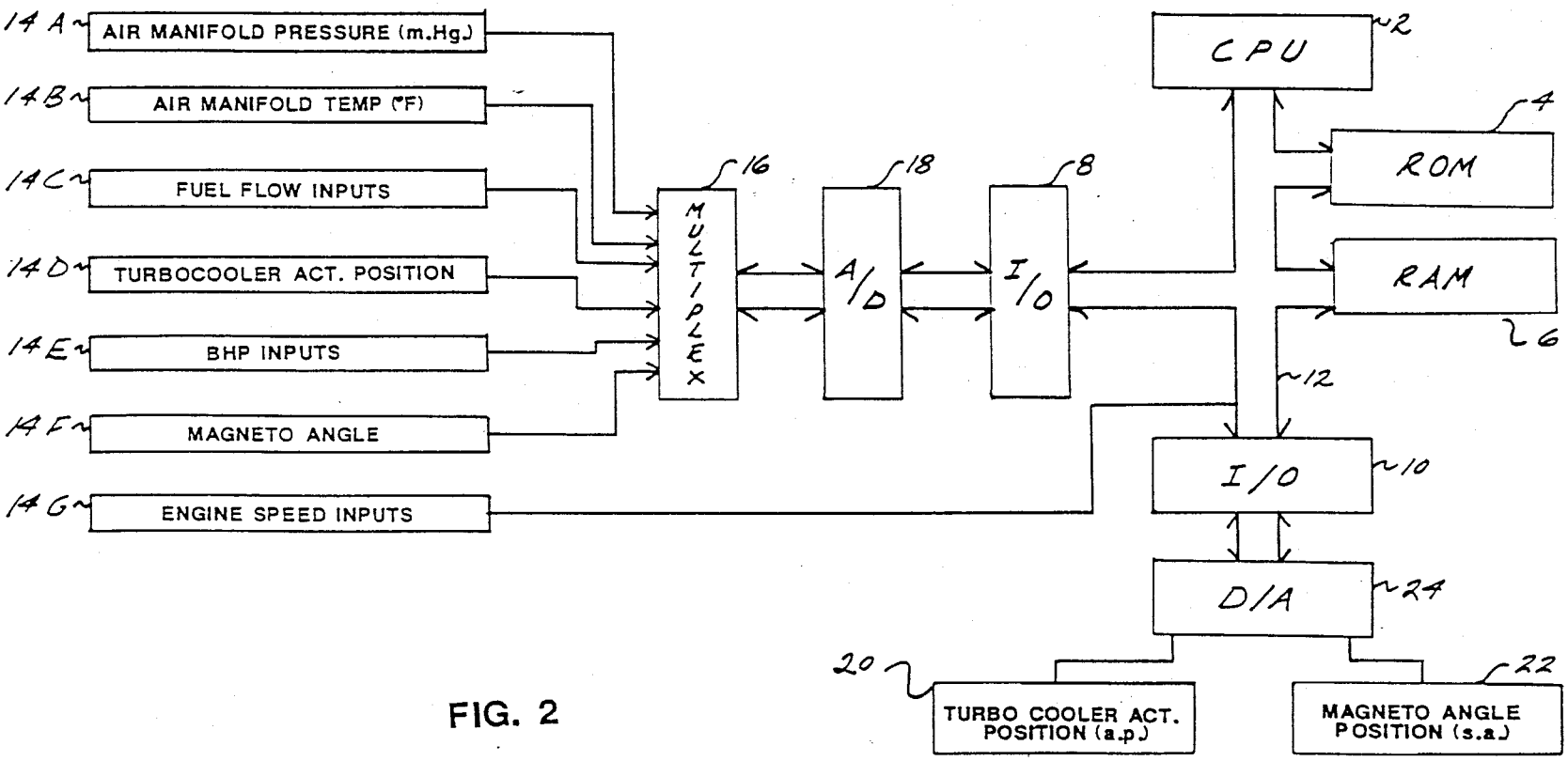
FIG. 2 is a schematic diagram of the apparatus for performing the method of the present invention.

The apparatus for controlling the engine in accordance with the present invention is indicated schematically in FIG. 2. The apparatus includes a central processing unit (CPU) 2 operatively connected with a read-only memory (ROM, PROM, or EPROM) 4, a random access memory (RAM) 6, and conventional input/output ports 8, 10 over a data/address/control bus 12. The CPU 2 reads input data through the input/output port 8, processes the data in accordance with the programmed instructions stored in ROM 4, and provides output data through the input/output port 10, in a conventional manner. In the preferred embodiment, the CPU 2 is a Texas Instruments TI-9995 microprocessor having 10K of internal memory, although other microprocessors can be employed.

The input data read by the CPU 2 is derived from a plurality of engine sensors 14A–14G schematically indicated in FIG. 2. The inputs derived from sensors 14A–14F are read through a multiplexer 16, which interfaces with an analog to digital converter 18, in a conventional manner. The sensor 14G, from which the engine speed input data is derived in a manner to be described, is provided directly to the CPU 2 via the bus 12.

The various engine sensors are conventional sensors coupled with the engine (and engine load where appropriate) in a known manner. Sensor 14A provides the air manifold pressure in inches of Mercury (in Hg.). Sensor 14B provides the air manifold temperature in degrees Fahrenheit (°F.). Sensor 14C provides inputs from various fuel line pressure and temperature sensors so that the fuel flow, or fuel consumption, can be derived by the CPU 2. In particular, the engine fuel line (not shown) includes pressure and temperature sensors associated with an orifice plate of a conventional fuel flow detector. The sensors, schematically represented by 14C, sense the downstream orifice plate pressure, the pressure drop across the orifice plate, and the fuel temperature. From this data, standard equations (provided by the manufacturer of the detector) are solved by the CPU 2 to obtain the fuel flow in standard cubic feet per hour (SCF/HR). It should be apparent that other methods and apparatus for providing a fuel flow input in SCF/HR could be used.

The turbocooler actuator position sensor 14D senses the position of the turbocooler actuator vane that controls the compressed air provided to the engine manifold. In the Cooper Bessemer LSV-16 engine, a turbocharger provides compressed air to a pair of turbocoolers that are connected with each engine air manifold. The turbocoolers include a turbine which provides the air, under pressure, to the air manifold. The turbocooler actuator vane is movable between an open and closed position to control the compressed air provided to the engine air manifold. The actuator vane position is sensed by sensor 14D in a conventional manner.

The sensor 14E provides inputs for detecting the brake horsepower (BHP) output of the engine for various engine loads. In the preferred embodiment, the engine load is a compressor, or pump, and various load conditions are required to be sensed in order to calculate the BHP. These sensed conditions include the compressor suction and discharge temperatures and pressures and the flow rate of the gas pumped by the compressor through the pipeline. From such sensed values, the BHP can be calculated by the microprocessor in a conventional manner.

The sensor 14F senses the magneto angle of the spark distribution system in a conventional manner.

The sensor 14G senses the engine speed in RPM. Each crank angle revolution is detected and the revolutions are provided to a 16 bit counter, the output of which is read by the CPU to determine the engine RPMs in a conventional manner. Other engine speed detection techniques can be effectively employed.

The CPU 2 reads the above-described engine inputs from the sensors 14A–14G and controls two engine effectors in accordance with the optimization technique to be described. The two engine effectors controlled in the preferred embodiment are the spark angle and the air manifold pressure. These are controlled by selective movement of a turbocooler actuator 20 and a magneto 22. In particular, the turbocooler actuator position and the magneto angle are controlled via the input/output port 10 and a digital to analog converter 24 which interfaces with the effectors 20, 22. The turbocooler actuator position ("a.p.") is moved by controlling current to pressure transducers in a conventional manner to move the actuator in accordance with the system control signals, to be described. The spark angle ("s.a.") is changed by controlling the magneto angle by conventional spark timing control methods in accordance with the engine control signals to be described. In general, the turbocooler actuator and the magneto are controlled by a conventional closed-loop control, wherein the control inputs will include the values determined by the optimization techniques to be described.

The CPU 2, in accordance with the program stored in the system memory, reads the various sensor values and determines the values of a plurality of engine variables that are operated upon by the supervisory trim logic system in a manner to be described. Generally, the engine variable values are operated upon to determine the magnitude and direction of movement of the actuator position and spark angle effectors to achieve a minimum fuel consumption. In the particular embodiment described herein, five separate engine variables are operated upon; these five variables are obtained as follows.

Figure 3:
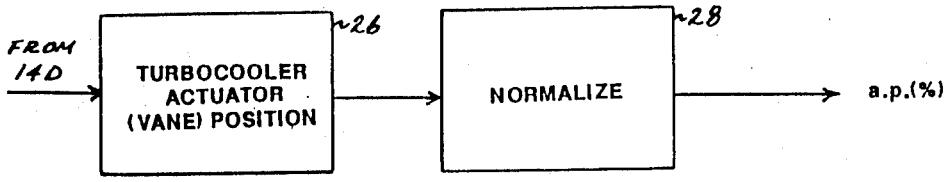
FIG. 3 is a diagram schematically illustrating the turbocooler actuator vane position variable.

The first engine variable is the turbocooler actuator position, normalized and expressed as a percentage. As depicted in FIG. 3, the actuator position derived from the sensor 14D is read by the CPU 2 (block 26), normalized, and expressed as a percentage (block 28). The CPU 2 assigns the fully-closed actuator position a value of 0% and the fully open actuator position a value of 100%. The actual actuator position read is calculated as a percentage of maximum actuator movement from the fully closed to fully open position. Thus, the actuator position variable ("a.p.") is expressed as a percentage.

Figure 4:
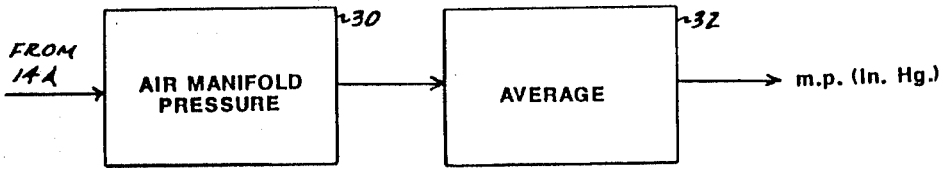
FIG. 4 is a diagram schematically illustrating the air manifold pressure variable.

The second engine variable is the air manifold pressure variable ("m.p.") expressed in inches Hg. As shown in FIG. 4, the air manifold pressure sensor is read by the CPU (block 30) and averaged over a predetermined time period (block 32) to provide the air manifold pressure variable ("m.p."). The averaging may be obtained by sampling the sensor over a ten-second period.

Figure 5:
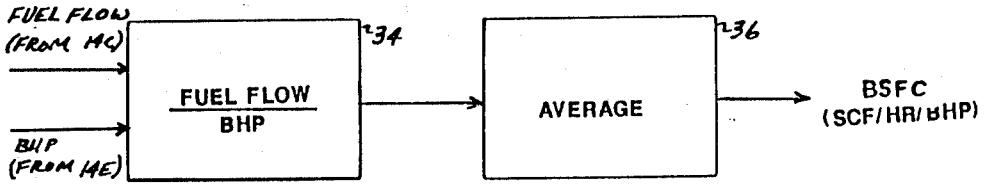
FIG. 5 is a diagram schematically illustrating the brake specific fuel consumption variable.

A third engine variable is the brake specific fuel consumption variable (BSFC), expressed in SCF/HR/BHP, as shown in FIG. 5. The BSFC variable is obtained (block 34) by dividing the fuel flow (derived from sensor 14C) by the BHP (derived from sensor 14E). The value obtained is averaged over a predetermined time value (block 36) to obtain the BSFC variable.

Figure 6:
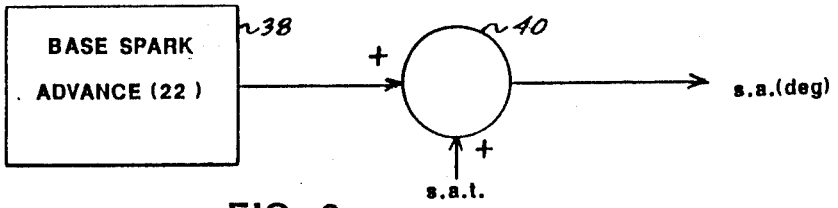
FIG. 6 is a diagram schematically illustrating the spark advance angle variable.

A fourth engine variable is the spark advance angle ("s.a."), expressed in degrees, as shown in FIG. 6. The spark angle variable is derived by reading a predetermined constant base spark advance angle that is stored in memory (decision block 38), and adding the spark angle trim value ("s.a.t.") thereto (block 40). The s.a.t. value is the trim value obtained by the supervisory trim logic system described below. The base spark angle is a predetermined spark setting, which, in the embodiment described herein, is 22°.

The fifth and final variable ("d.k.l.") is the value that the spark angle can be advanced until the engine reaches a knock condition, i.e., until a knock line ("k.l.") is reached. A reciprocating piston engine will begin to experience engine knock at certain engine operating conditions. One can empirically measure the various engine variable values, such as the spark advance angle, at which a knock occurs, map these variables, and store these mapped variables in the system memory (ROM). This map is called the knock line map. In the instant invention, the spark advance angle at which knocking will occur is accessed by the CPU, and this knock line spark angle value ("k.l.") is compared with the actual spark angle variable ("s.a.") to determine the difference therebetween ($d.k.l. = k.l. - s.a.$).

To obtain the knock line map, empirical measurements of the engine are made and stored in ROM. First the engine is placed in a steady-state condition and the brake mean effective pressure (BMEP) of the engine is calculated, which is the engine output load or torque. The BMEP is conventionally defined as the brake horsepower divided by the engine speed times a constant (K), a well known calculation. That is, $$BMEP = K\frac{BHP}{\text{Engine Speed}} \quad (1)$$

After the BMEP is calculated, the spark angle is adjusted until a knock is detected. (The knock may be detected by vibration sensors attached to the cylinder head and read by an oscilloscope.) The value of the spark angle is measured. Also measured, by conventional techniques, is the cylinder pressure (PK) value at which the knock is detected. One repeats this process until sufficient data is obtained so that, for a fixed BMEP, a map of the spark angle and cylinder pressure (PK) at whiCh knocking occurs can be obtained. One repeats this process empirically for a plurality of different BMEP values, and this map is stored in system ROM.

The cylinder pressure PK can also be theoretically calculated, based upon the assumption that the engine fuel (methane, in the preferred embodiment) is adiabatically compressed and that there is a fixed temperature at which the methane gas will self-ignite, or detonate. This theoretical calculation for PK is as follows:

$$\frac{P2}{P1} = \left(\frac{T2}{T1}\right)^{\frac{K}{K-1}}$$

where,

P2=PK;

P1=air manifold pressure;

T2=detonation temperature=1950° R;

T1=air manifold temperature
+ temperature rise due to induction to the cylinder (150° F.)
+460° F. constant to convert to °R; and
K=the ratio of specific heats for methane (1.35)

Rewriting, the equation for PK may be expressed as follows:

$$PK = (\text{Air Manifold Pressure})\left[\frac{1950}{(\text{Air Manifold Temp.}) + 610}\right]^{3.857} \quad (2)$$

The equation (2) is stored in system ROM. Thus, the CPU can read the air manifold pressure and temperature and calculate PK in accordance with equation (2). The CPU can similarly read the BHP and the engine speed and can calculate the BMEP in accordance with equation (1). With these values obtained, the CPU can then check the knock line map for the particular values of PK and BMEP and read the spark angle at which knock occurs (k.l.).

Figure 7:
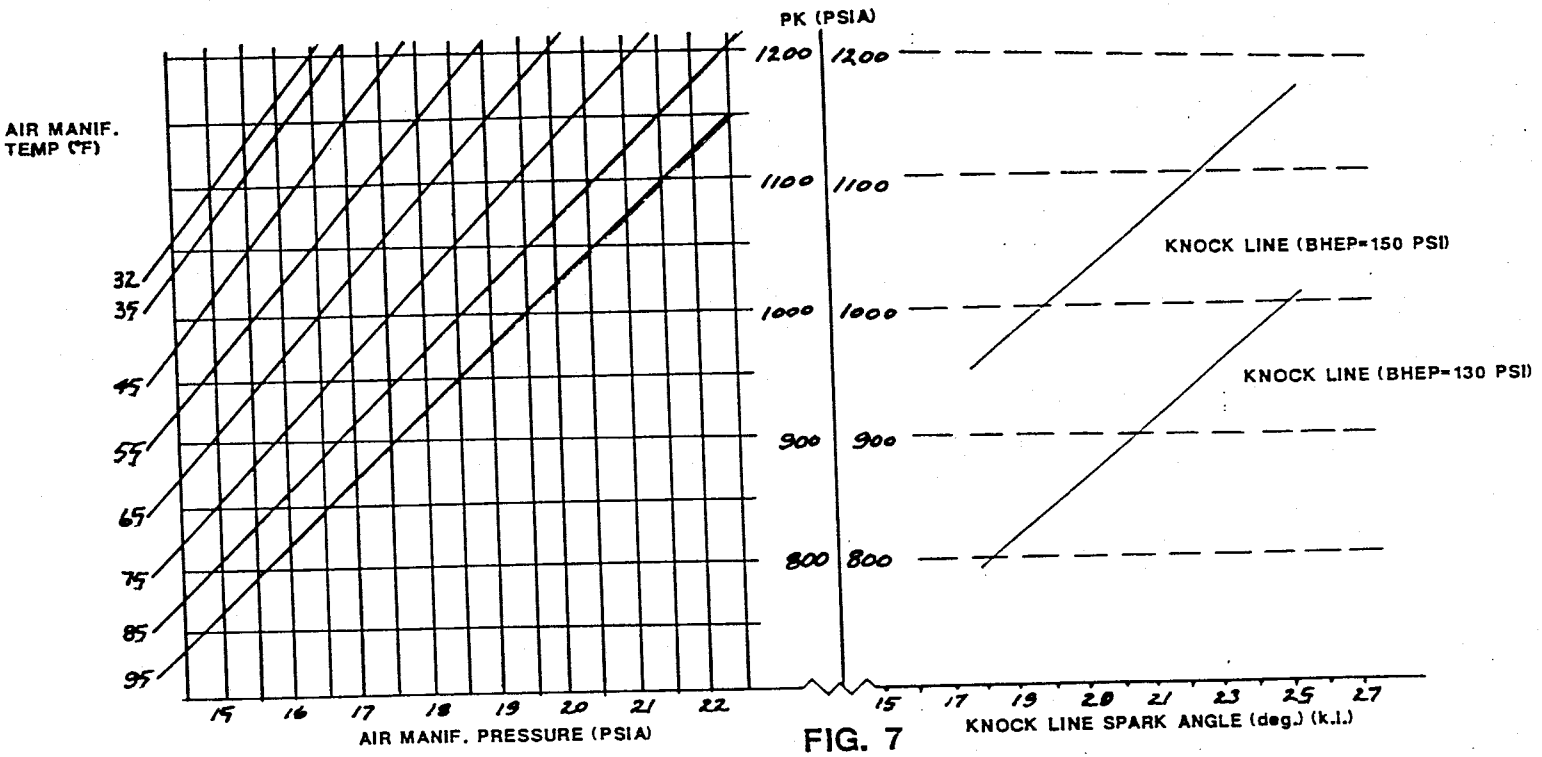
FIG. 7 is a graphical representation of the engine knock lines.

FIG. 7 is a graphical representation of the empirical knock line maps and the theoretical PK calculation. With reference to the graph on the right, a plot of two knock lines, at BMEP=150 and BMEP=130, is shown as a function of PK and knock line spark angle (k.l.). These two knock lines were obtained empirically in the manner discussed above. The graph on the left depicts PK as a function of the air manifold temperatures and pressures. The PK values were calculated in accordance with equation (2) above. With reference to FIG. 7, if, for example, the CPU reads the air manifold temperature at 75° F. and the air pressure at 17.5 PSIA, the PK is read as 1,000 PSIA. For a BMEP of 150 PSI, the knock line spark angle (k.l.) is approximately 20°.

Figure 8:
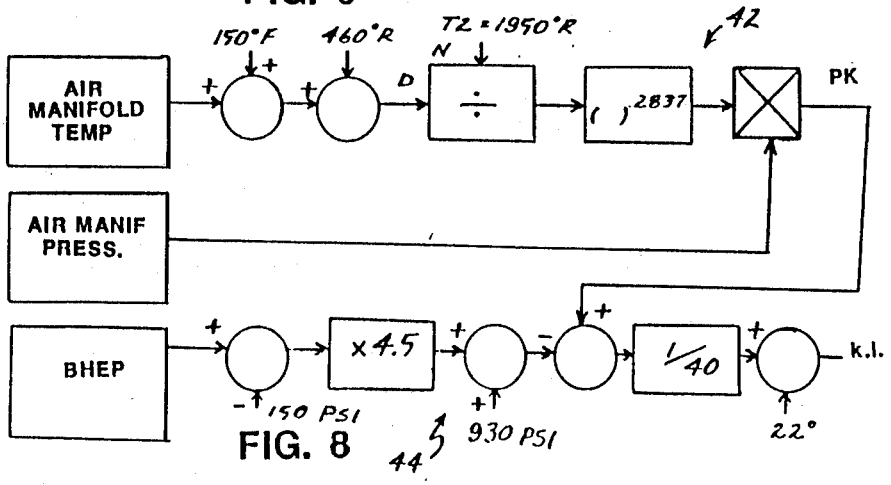
FIG. 8 is a diagram illustrating the equation for the calculation of the knock line variable.

From the knock line maps, as shown in FIG. 7, one may calculate actual knock line equations. It may be observed, from FIG. 7, that the knock lines are relatively linear. This makes the determination of the knock line equations relatively straightforward. Reference should be made to FIG. 8, which is a representation of how the k.l. variable may be calculated by the CPU. The PK value is calculated using equation (2), which is depicted by numeral 42 of FIG. 8. The BMEP and PK values are then operated upon by the calculated knock line equation, as shown by numeral 44, to obtain the k.l. variable. That is, with reference to numeral 44, 150 PSI is subtracted from the BMEP. This value is multiplied by 4.5 and 930 PSI is added to the result. This result is subtracted from PK, and multiplied by 1/40. This value is added to 22° to obtain k.l.

The CPU calculates the difference between the knock line spark angle (k.l.) and the actual spark angle read (s.a.) to compute the fifth variable ($d.k.l.=k.l.-s.a.$) used by the supervisory trim logic system.

Figure 9:
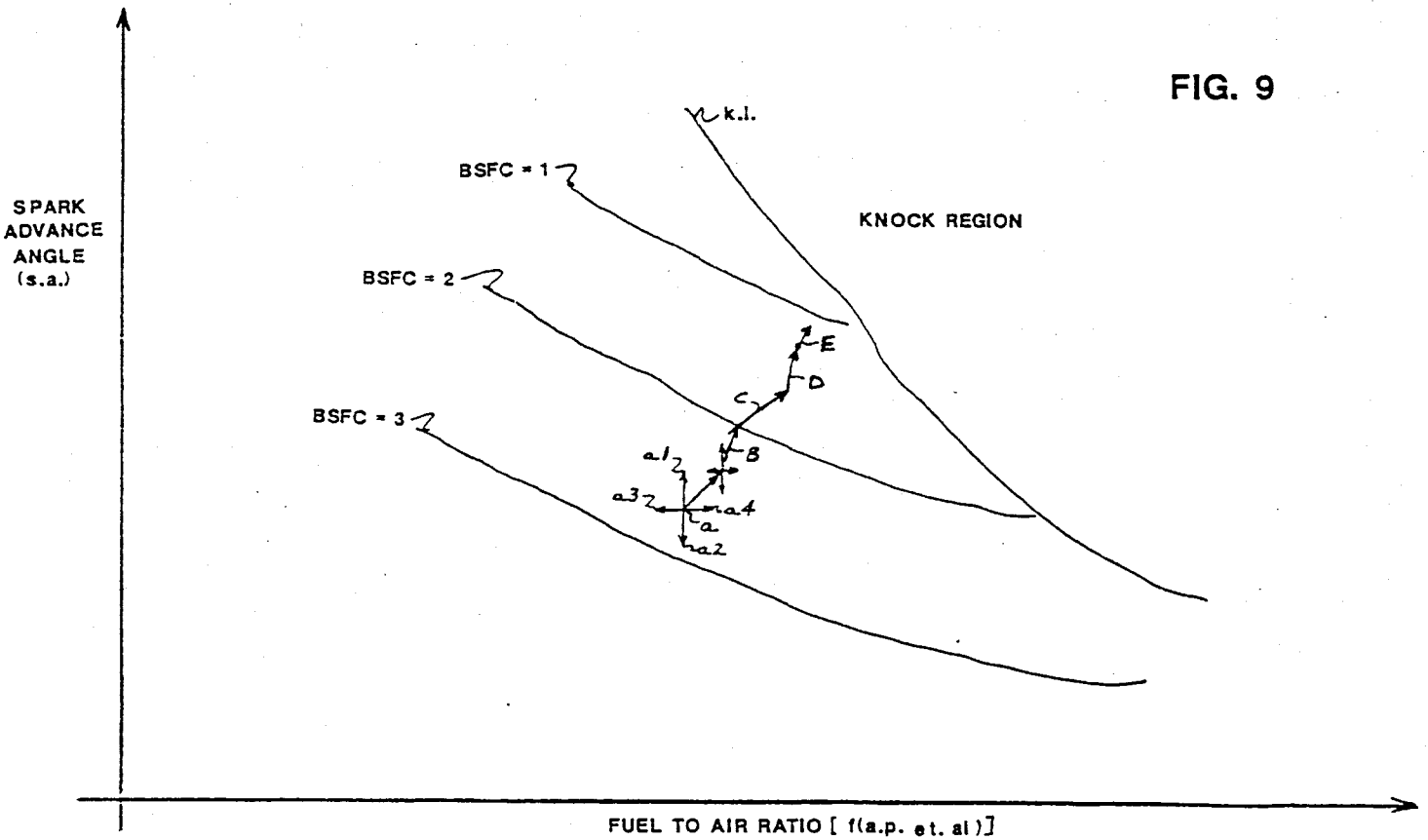
FIG. 9 is a generalized graphical representation of the effector movements for obtaining minimum fuel consumption.

Before proceeding with a detailed description of how the supervisory trim logic (STL) operates upon the above-described five variables to perform its intended functions, a general discussion of the overall goals of the STL system will be described with reference to the graphical representation of FIG. 9. The vertical axis of FIG. 9 represents the spark advance angle and the horizontal axis represents the fuel-to-air ratio. Plotted as a function of these two values are constant brake specific fuel consumption (BSFC) lines. Also represented on the graph of FIG. 9 is a knock line (k.l.).

The supervisory trim logic of the present invention is designed to selectively control the spark advance angle and the air manifold pressure to place the engine in an operating condition closest to the lowest BSFC line without entering into a knock region. The fuel-to-air ratio (fuel consumed divided by air consumed) is a function of a plurality of engine variables including the air manifold pressure. Thus, an increase in air manifold pressure lowers the fuel-to-air ratio; a decrease in air manifold pressure increases the fuel-to-air ratio. Thus, by selectively moving the spark advance angle and/or the air manifold pressure effectors in a particular vector direction, the supervisory trim logic searches for the lowest BSFC without violating any engine variable limits (that is, for example, exceeding the knock line limit).

The plurality of engine variables that are operated upon by the STL system have inherent operating limits. These operating limits are determined in advance and stored in system memory (ROM). For example, since the engine is to be operated in a steady-state, one can readily determine the limits of each variable by empirical methods. One can determine the overall minimum and maximum ranges of manifold air pressure for example. Similarly, the actuator position range of movement can be readily observed. This may be between 15 and 85%, for example. For each engine variable, their operating limits are stored in system ROM.

In order to move the spark advance angle and the air manifold pressure in a direction to minimize BSFC without violating any of the predetermined operating limits of the engine variables, the STL functions as follows. First, the STL positions the engine at a starting point so that all engine variables are within a predetermined initial region. If the system is not within the region, the supervisory trim logic selectively moves the spark advance angle and the air manifold pressure until the starting point is reached. With reference to FIG. 9, the starting point is indicated as point a. From the starting point a, the supervisory trim logic moves each of the two effectors one at a time a predetermined amount in both a positive and negative direction about the origin a in order to sample the variables at each point and to determine the sensitivity of each variable to a change in the effector movement. For example, the STL first moves the spark advance angle 2° upward (to point a1), reads all of the engine variable values and stores such values in memory. The spark advance is then returned to the origin a and moved downward a predetermined value, such as 2°, to point a2. At that point, the STL again reads all of the variables and returns to the origin. For each of the five variables that are sampled, the STL obtains the sensitivity of each of the variables per unit of change in the spark advance angle. Sensitivities are obtained by subtracting the variable value at point a2 from the variable value at point a1 and dividing the result by the total change in effector movement (4°). These sensitivities are stored in memory. The system then selectively moves the air manifold pressure in an upward and downward direction (to points a3 and a4), reads the values of the variables at each point, and similarly determines the sensitivity of each of the five engine variables to a change in air manifold pressure. This process is generally referred to as the sampling process.

As a result of the sampling process, a series of partial differential equations, stored in a matrix, are obtained.

As will be described hereinbelow, these equations are solved by an iterative technique generally known as the simplex algorithm, whereby the spark advance angle and air manifold pressure movements are determined as a function of the various engine sensitivities to move the engine in a direction of lowest BSFC. The spark advance angle and air manifold pressure are then moved simultaneously in a vector direction (indicated by vector A) in accordance with the various sensitivities and without violating any of the operating limits of the engine variables. Thus, the engine is now at a new origin b and the STL repeats itself and keeps moving the effectors (along vectors B, C, D, and E, for example) until no improvement in BSFC can be obtained without violating an engine variable limit. This point is then deemed to be the best point and the engine remains at such point until the engine conditions have changed such that the system is now violating an engine limit or until one of the engine variables has changed by a predetermined amount. In such case, the STL system withdraws the engine within limits and then attempts to locate a new optimum.

Figure 10:
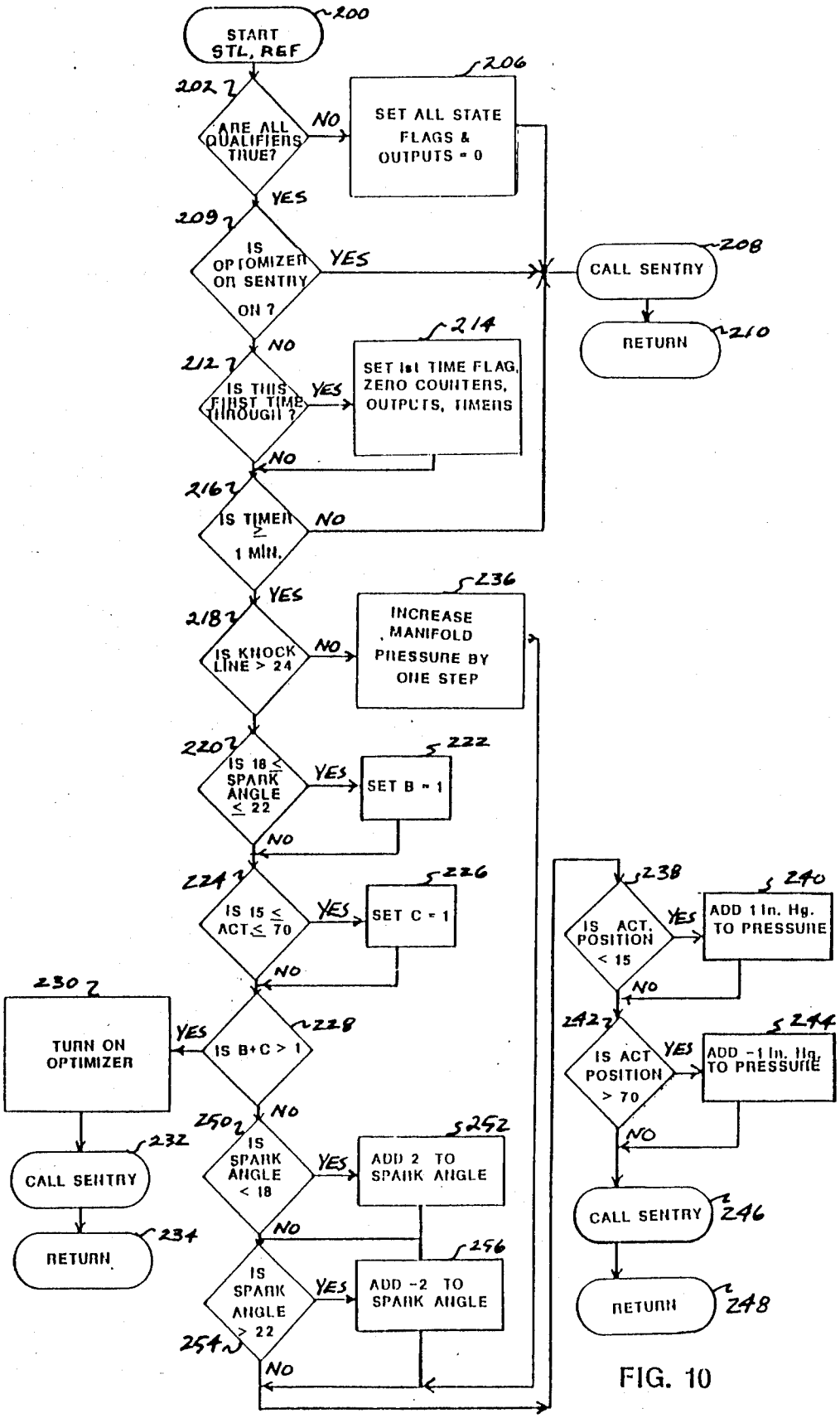
FIG. 10 is a flow chart of the STL PREP routine.
Figure 11:
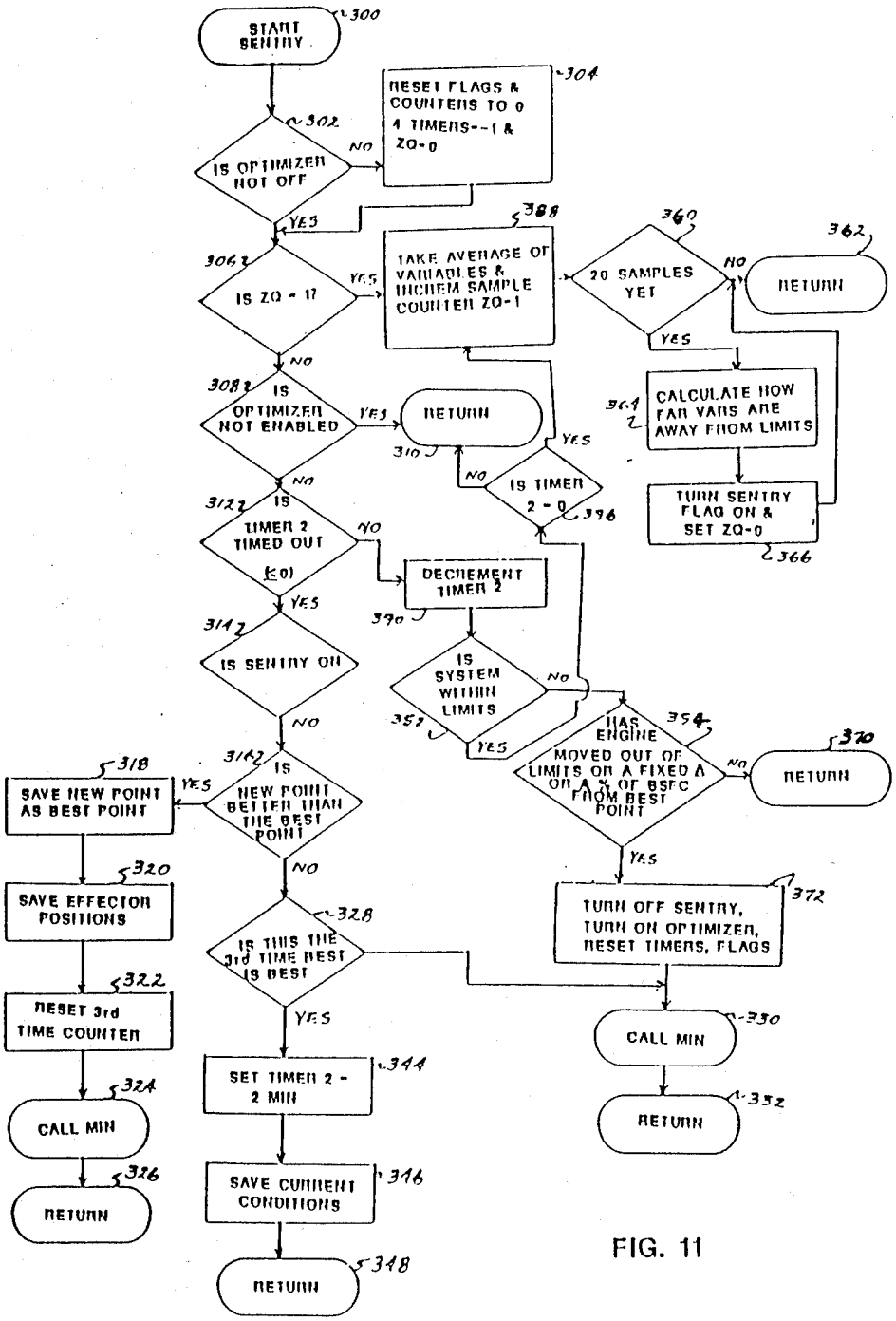
FIG. 11 is a flow chart of the SENTRY routine.
Figure 12:
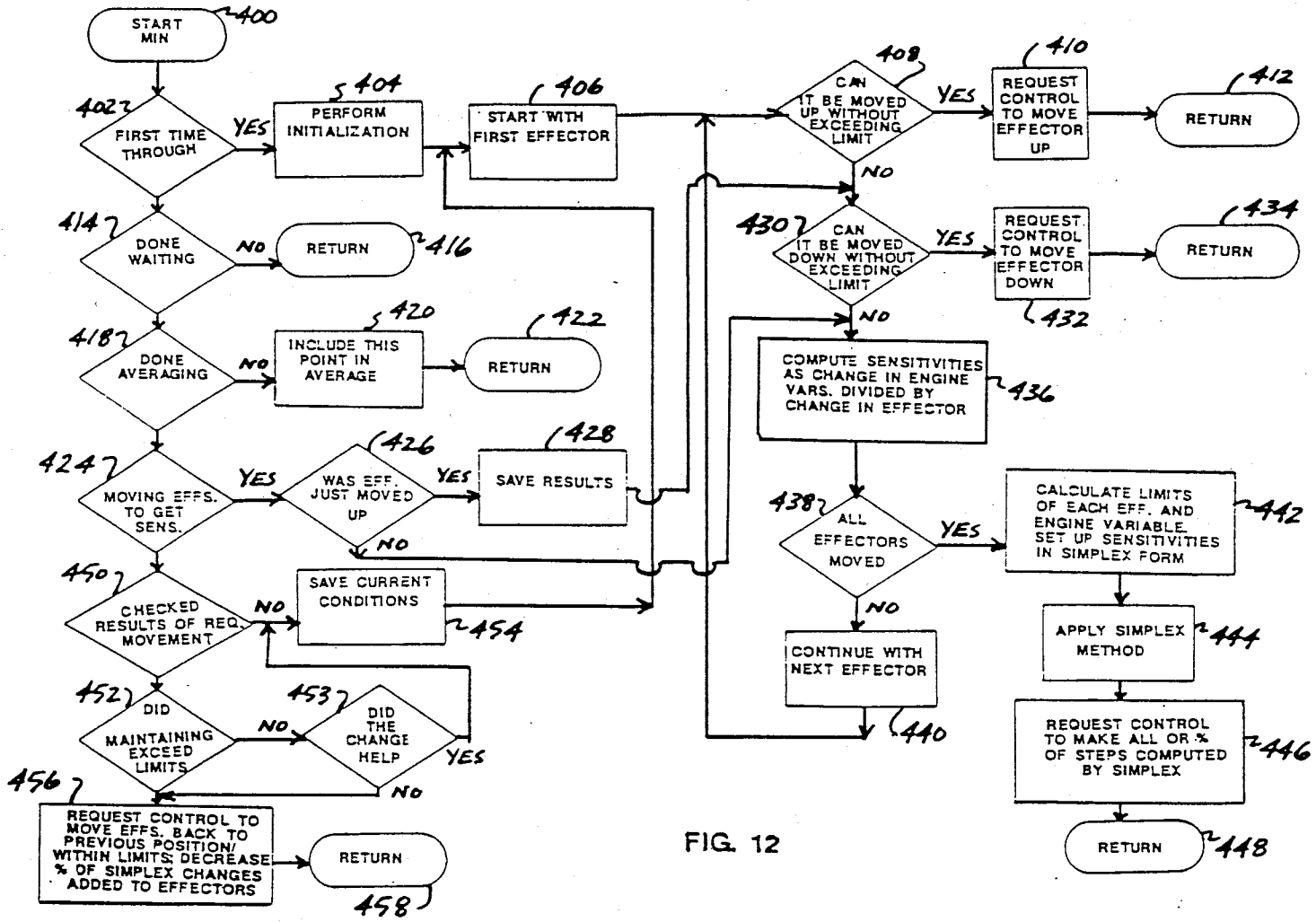
FIG. 12 is a flow chart of the MIN routine.

Turning now to the specific implementation of the STL system, the system includes at least three major program routines. The first routine, called the STL PREP routine, is depicted in FIG. 10, the SENTRY routine is depicted in FIG. 11, and the minimization or MIN routine is depicted in FIG. 12. In general, the STL PREP routine is the entry point of the overall optimization process and functions to set the engine within its initial starting region. The SENTRY routine acts as a qualifier for the MIN routine to see if any improvement in BSFC is attainable. Following the completion of the engine optimization, SENTRY monitors all of the engine variables to determine if any of the variables have exceeded their operating limits or if any of the engine variables have moved more than a predetermined amount, in which case the MIN routine is again activated. The MIN routine generally functions to determine the sensitivities of the variables per change in effector, and to determine the trim vectors that move the engine to a point of minimum BSFC. Each of the overall routines will now be described.

The STL PREP routine (FIG. 10) starts (block 200), or is entered, after all of the engine variables are determined from a reading of the engine sensors. That is, with reference to FIG. 1, after the variables are determined (block 102), the STL PREP routine is called as exemplified by block 104. The STL PREP routine, when called, first determines if all engine qualifiers are true (decision block 202). These qualifiers may include various on/off switches located on a system control panel which are settable to turn the supervisory trim logic system on or off. Further, in the preferred embodiment, the engine to be controlled is designed to operate at a steady state condition. Thus, one of the qualifiers is whether the engine has accelerated more than a predetermined amount. If so, the system waits until the engine is operating at a relatively constant velocity. Another engine qualifier may be the overall engine speed. For example, it may be desirable to initiate the supervisory trim logic system only after the engine exceeds a certain speed. In essence, the qualifiers include all of the engine conditions or control conditions that must be satisfied in order to enable the STL system. If all of the qualifiers are true, the system proceeds to decision block 204. If the qualifiers are not true, the system sets all of the internal flags and outputs to 0 (block 206) and calls the SENTRY routine (block 208). The function of the SENTRY routine will be described below. For now, it is sufficient to say that the SENTRY routine, when called in response to an output from decision block 206, will simply loop back and return to enter decision block 210. At decision block 210, the system returns to FIG. 1, the STL block 104, the engine variables are again determined, and the system re-enters the STL PREP routine at 200. It is thus seen that the STL system will not proceed further until all of the qualifiers are true as represented by decision block 202.

Assuming all of the qualifiers are true, the system then checks if either an optimizer flag or a SENTRY flag is on. If affirmative, the system again calls SENTRY (block 208). The setting of the optimizer and SENTRY flags will be described further below.

Assuming that the optimizer or SENTRY flags are not on, the system proceeds to decision block 212 which checks if this is the first time through. If it is, the system proceeds to decision block 214 wherein a first-time flag is set and all counters, outputs and timers are zeroed. If this were not the first time through, or following the satisfaction of decision block 214, the system proceeds to decision block 216 to determine if a timer has exceeded one minute. If it has not, SENTRY is called (block 208). As will be described below, when SENTRY is called at this point, the system will merely return and wait until one minute has elapsed. After the timer value exceeds one minute, the system checks if the knock line (k.l.) exceeds a predetermined value, in this example, a value of 24. The predetermined knock line value is obtained from ROM. Generally, the knock line must be at a value so that the spark angle can be advanced its predetermined step value without entering a knock region. As discussed above, the initial spark angle is set at 22°. Thus, for a 2° step, the knock line must be at least 24°.

Under normal conditions, the knock line will be greater than 24 when in an initial or starting condition. In such case, the system then checks to determine if the spark advance angle is within predetermined limits, such as between 18° and 22° as exemplified by decision block 220. If so, the normal situation, a variable B is set to 1 (block 222). The system then checks to determine if the actuator vane position (a.p.) is within a predetermined starting region (block 224) and, if so, variable C is set to 1 (block 226). The actuator vane position must be such that it can be moved to enable the supervisory trim to obtain sensitivities. In the preferred example, the system determines if the actuator is between 15% and 70% of its maximum position, as exemplified by decision block 224.

The STL routine proceeds to determine if the value of B+C is greater than 1 (decision block 228). This can only occur if the results of decision blocks 220 and 224 were both affirmative, i.e., that the spark angle and the actuator vane position were within their predetermined starting range. Since this is the typical condition when the STL system is first entered, decision block 228 will be affirmative and the optimizer flag is set (block 230) and the SENTRY routine is called (block 232). As will be discussed below, the calling of SENTRY at decision block 232 will, in turn, activate the MIN routine and start the optimizing process. The optimizing or MIN process will typically continue until supervisory trim outputs are obtained. The system returns from MIN, to SENTRY, and back to STL PREP, and then returns (block 234) to FIG. 1 where the STL movement values are interjected into block 106. The controller then controls the effectors in accordance with the supervisory trim outputs.

Let us consider the case where the knock line was not greater than its predetermined starting value as reflected by a negative determination of decision block 218. The system would then increase the air manifold pressure by 1 "step" (decision block 236). A "step" is a predetermined amount, which may be one inch Hg. The system then determines if the actuator position is less than 15% (decision block 238). If it is, one inch of mercury is added to the manifold pressure (decision block 240). The system then checks if the actuator position is greater than 70% (decision block 242). If it is, one inch of mercury is subtracted (decision block 244). SENTRY is then called (decision block 246) and will return (decision block 248) in a manner to be described.

As a result of the above-described steps, it should be apparent that the system will continue to alter the air manifold pressure until the knock line is greater than its predetermined value (k.l. greater than 24) and the output of decision block 218 is "yes". At this point, the spark advance angle position is checked (decision block 220), followed by a check of the actuator position (decision block 224). If the spark advance angle and the actuator position are not within the ranges as defined by decision blocks 220 and 224, the output of decision block 228 will be "no" and the spark angle is adjusted. In particular, when the output of decision block 228 is "no", the system checks if the spark angle is less than its lower limit, preferably 18° (decision block 250). If it is lower than its lower limit, 2° is added to the spark angle (block 252). The system then checks if the spark angle is greater than its upper limit of 22° in the preferred example (decision block 254). If it is, the spark angle is reduced by 2° (block 256). The system then checks and alters the actuator position, if necessary, by decision blocks 238–244.

The STL PREP routine continues until all of the initial conditions of knock line, spark angle and actuator position are satisfied. This will be indicated by an affirmative output of decision block 228, which will set the optimizer flag (block 230) and call SENTRY (block 232).

Let us now consider the SENTRY routine as schematically indicated by the flow chart of FIG. 11. As discussed earlier, the SENTRY routine acts as a qualifier for the MIN routine and operates in conjunction with the MIN routine to determine when the effectors have been moved to their optimum position, that is, to a position where the BSFC is minimized. When the BSFC has been minimized, the SENTRY routine then monitors the engine variables to determine whether the engine operating conditions may have moved out of limits or whether the engine variables have moved a predetermined value. In essence, the SENTRY routine works in conjunction with the MIN routine to move the effectors to their optimum conditions and also acts as a watchdog after the optimum conditions have been reached.

The SENTRY routine starts (decision block 300) by checking the status of the optimizer flag (decision block 302). It should be recalled, from FIG. 10, that the optimizer flag is turned on (set to 1) from decision block 230. If the optimizer is off, as indicated by a "no" determination from decision block 302, the SENTRY routine resets all of its internal flags and counters to 0, sets the timer values to −1, and sets a ZQ variable to 0 (block 304). If the optimizer is not off, as indicated by an affirmative output of decision block 302, the system then checks if ZQ is equal to 1 (decision block 306). During the initial operation of the SENTRY routine, the ZQ variable will not be 1, and the system thus proceeds to decision block 308. As will be discussed further below, the ZQ variable is set to 1 only after the SENTRY flag is set, and various other conditions are satisfied.

Decision block 308 checks to see if the optimizer is not enabled (not equal to 1). That is, if the optimizer flag is 0, the system returns (through block 310) to the STL PREP routine. If, on the other hand, the optimizer has been set (from block 230 of FIG. 10), the SENTRY routine proceeds to decision block 312. There, the system determines if a timer 2 has timed out (less than or equal to 0). At least in the initial state, prior to the MIN routine locating the optimum variable position, the timer 2 flag is set to −1 (by decision block 304). Thus, the timer 2 flag is less than 0, and the system proceeds to decision block 314. Decision block 314 checks to see if the SENTRY flag is on. The SENTRY flag will be set on in a manner to be described further below. If the SENTRY flag is not on, the system proceeds to decision block 316.

At decision block 316, the CPU reads the various engine variables and determines if the engine is at an operating position that is better than its previous operating position. As will be discussed further below, the MIN routine selectively moves the two effectors a certain magnitude and direction so as to minimize BSFC. The MIN routine continues until no improvement is obtained, i.e., until the change in engine effectors do not result in any improvement of BSFC. Thus, the decision block 316 determination will be affirmative if a movement of the engine effectors during the MIN routine resulted in an improvement. If it had, the system continues to decision block 318, wherein the new location is saved as the best point, the effector positions are saved and stored in memory (block 320), a third time counter is reset (decision block 322) which will be described further below, and the MIN routine is called (decision block 324). Upon completion of the MIN routine, the system returns and proceeds to decision block 326, where the system returns to the STL PREP routine.

In the event the decision block 316 determination is negative, i.e., that the new point was not better than a previous point, the system will proceed to decision block 328. The routine will then check if this is the third time, consecutively, that the effectors have been moved and no improvement has been obtained. (This is accomplished by checking the third time counter as mentioned in connection with block 322.) If less than three consecutive "best" readings have been obtained, the system will call the MIN routine (decision block 330) and then returns (decision block 332) upon completion of MIN. If, on the other hand, decision block 328 indicated that the present point was the best point for three consecutive sequences, the output of decision block 328 is "yes" and a timer 2 is set to two minutes (block 344). The present variable conditions are then saved in memory (block 346) and the system returns (block 348) to the STL PREP routine.

From the above description, it should be apparent that when the SENTRY routine is called, with the optimizer flag set, the SENTRY routine will continue to call the MIN routine (at decision block 330) until the MIN routine has made three consecutive unsuccessful attempts to improve the BSFC. If no improvement can be obtained for three consecutive attempts, the timer 2 will be set to two minutes (block 344), the conditions saved (block 346), and the system returns to STL PREP at block 232 of FIG. 10. The STL PREP routine will return to FIG. 1, block 104, the engine effectors will be actuated in accordance with the STL outputs to block 106, new variables will be read, and STL PREP will again be called (block 104). The STL PREP routine will ultimately call SENTRY again.

Let us now consider the SENTRY routine flow path following the exiting of SENTRY through block 348. Upon a return to the start of SENTRY, the system checks if the optimizer is still on (decision block 302), which will still be affirmative. The system then checks if ZQ equals 1 (decision block 306), which is still negative. Since the optimizer flag is still on, the output of decision block 308 will be "no", and the system enters decision block 312. Since the timer 2 had been set to two minutes (at decision block 344), the timer 2 is not timed out (at least for the first two minutes), and the decision block 312 determination is "no". The timer 2 is decremented (decision block 350) and the system checks if all engine variables are within limits (decision block 352). At decision block 352, the microprocessor reads the various variable values and determines if the present location of the engine variables exceeds the predetermined operating limits of any of these variables. If the system has moved outside of its limits, caused by a general engine drift, the system proceeds to decision block 354, which will be described further below. If, on the other hand, the system is still within limits, the determination of decision block 352 is "yes", and the system proceeds to decision block 356. Here, the timer 2 output is checked to see if it has timed out or reached 0. If it has not, the system returns, through decision block 310. The system will continue to loop until the output of decision block 356 is "yes" (i.e., the timer 2 equals 0), and the system proceeds to decision block 358.

At decision block 358, the system will read the variables and compute an average variable value over 20 samples. That is, the system will read the engine variables and set a flag ZQ=1. A sample counter will be incremented and, at decision block 360, the system will determine if 20 samples have been obtained. If they have not, the system returns (decision block 362) to the STL PREP routine which ultimately returns back to the start of SENTRY (decision block 300). The system will proceed through SENTRY until decision block 306, which inquires if ZQ is 1. Since ZQ is now 1, the system proceeds through decision block 358, where the variables are again read and averaged, the sample counter is incremented, and the system proceeds through decision blocks 360 and 362 until the variables have been read over a period of 20 samples. In such case, the decision block 360 determination is "yes", and the system proceeds to block 364. At this point, the CPU calculates how far the variables (as averaged over 20 samples) are away from each of their respective limits. This information is stored in memory and the SENTRY flag is turned on and ZQ is set to 0 (block 366). The system then returns through block 362.

When SENTRY is again entered, the system will proceed through decision blocks 302, 306, 308, and 312, to decision block 314, which checks if the SENTRY flag is now on. Since SENTRY had been set "on", the determination of decision block 314 is affirmative, and the system proceeds to decision block 354.

At decision block 354, the SENTRY routine checks for three possibilities. First, it checks to see if the engine has moved or drifted to a point where any of the variables are out of their limits. This is done by the microprocessor continually reading the variable values and comparing the values with the preprogrammed limits of each variable. Decision block 354 also checks if any of the variables have moved or drifted by a predetermined amount. These amounts are predetermined and stored in the system ROM. In essence, the SENTRY routine checks if a variable has changed a certain amount from the average value that had previously been calculated and stored. Third, the decision block 354 determines if the BSFC has moved more than a predetermined percentage away from what had previously been calculated as its best point. In essence, the microprocessor reads the BSFC variable and compares it with the best point value (that had been stored by decision block 318) and determines if the difference exceeds a predetermined percentage.

The SENTRY routine will continue to loop through decision block 314 and 354 and return (block 370) until the determination of decision block 354 becomes "yes", indicating that the system is either out of limits or that a change in the engine operating conditions has occurred, as discussed above. The affirmative determination of decision block 354 turns off the SENTRY flag, turns on the optimizer flag (in the event the optimizer flag had been reset by the STL PREP routine, discussed below), resets all timers and flags (block 372) and calls the MIN routine (block 330). (In the event that the engine had not moved out of limits, but rather drifted by a predetermined amount, the flag of decision block 453, in the MIN routine is set to "yes", as will be discussed below.) The MIN routine is then activated to find a new optimum condition.

The optimizer flag will stay on unless and until the STL PREP routine determines that the qualifiers are no longer true (FIG. 10, decision block 202). The negative determination of decision block 202 causes a reset of all of the state flags, including the optimizer flag, to 0 (at block 206).

Let us now consider the MIN routine as set forth in FIG. 12. The MIN routine will be described in a sequence that generally conforms with the operating sequence of the overall system from the first time through until completion, i.e., until the SENTRY routing has determined that the optimum conditions have been reached.

The MIN routine starts (decision block 400) and checks if this is the first time through the routine (decision block 402). If it is the first time through, the MIN routine initializes its internal counters, flags and timers and reads and stores the current value of each of the variables, including BSFC (block 404). The system then starts with the first of the two effectors (block 406). As has been described above, the optimization system of the present invention has two effectors, the spark advance angle and the air manifold pressure, that are selectively changed in order to minimize the BSFC. The system will select the first effector (block 406) and determine if it can be moved in an upward direction without exceeding any of the five variable limits (decision block 408). That is, the CPU determines the various values of the variables, and determines if the first effector, for example, the spark advance angle, can be moved a predetermined incremental trim value (2°) without violating any of the predetermined variable limits. In order to predict whether a variable will be outside of its limit upon movement of an effector, the system generally must know the sensitivity of that variable to a change in effector value. That is. the system must know the rate of change of a variable with respect to an effector movement. The first time through the MIN routine, such sensitivities are unknown, and thus assumed to be 0. In subsequent passes through the MIN routine, the sensitivities of each variable with respect to change in effector value will have been calculated and stored in the system memory. Essentially, decision block 408 reads the present variable value, and adds to that value the factor of the variable sensitivity multiplied by the change that the effector is to move. If the value exceeds a variable limit, then the determination of decision block 408 is "no". This is done for each of the five variables, and if any one of the variables is "no", the output of decision block 408 is negative. Since the sensitivity values are initially 0, the initial determination of decision block 408 will be affirmative, and the system will then request the engine control to move the effector up one step (block 410). For example, the spark angle trim is preset at 2°. (That is, 2° is equal to one step of the spark angle trim.) As such, decision block 410 will request movement of the spark advance angle up 2° from its present position and then return (block 412). The system will return to SENTRY, and then to STL PREP and back to STL of FIG. 1, and return via STL PREP back through SENTRY to again call the MIN routine. The MIN routine is then re-entered at 400.

The MIN routine proceeds from decision block 400 and through decision block 402. (The decision block 402 will be "no", since this is no longer the first time through.) From decision block 402, the system checks to see if a timer has timed out a predetermined value (decision block 414). The time is preferably one minute, which is sufficient time to allow the overall engine operating conditions to settle into their steady state. If one minute has not elapsed, the system returns (block 416) and continues to loop in such manner until the predetermined time has elapsed and the determination of decision block 414 is affirmative.

The system then proceeds to decision block 418 and the values of the variables are read and averaged over a predetermined time period. The system preferably samples the variable values 20 times. That is, if averaging is not completed (decision block 418 having a "no" determination), the instantaneous values of the variables are read (block 420), and the system returns (block 422). This loop is continued until the variables are sampled over 20 passes and this average value of each of the variables is stored in system memory. When averaging is completed, such that the determination of decision block 418 is affirmative, the system checks to see if it is in the process of moving the effectors to get the sensitivities of the variables (decision block 424). In the present example, since the system is in the process of moving effectors to calculate the variable sensitivities, decision block 424 has an affirmative output and the system checks if the effector was just moved in an upward direction (decision block 426). In the present example, the effector was, in fact, moved in an upward direction, making the determination of block 426 affirmative, and the results of such effector movement are saved (block 428) and the system proceeds to decision block 430. There, the system checks if the effector can be moved downward without exceeding a limit. If the result is "yes", the system requests the engine controller to move the effector in a downward direction a predetermined step value (block 432) and the system returns (block 434). It should be apparent that the system will return from the MIN routine, through the SENTRY routine, back through the STL PREP routine, and to FIG. 1, where the engine controller will move the effector accordingly. The system will then go back through the STL PREP and SENTRY routines to enter the MIN routine at decision block 400 once again.

When back in the MIN routine, the system passes through decision block 402, waits a predetermined time (decision block 414), calculates the average variable values (decision block 418), and passes to decision block 424, where a flag will indicate that we are still moving effectors to calculate the sensitivities. From decision block 424, the system proceeds to decision block 426 and determines if an effector was just moved up. In the example provided, the effector had not just moved up, and therefore the determination of decision block 426 is negative and the system proceeds to block 436.

Block 436 computes the sensitivities as a change in engine variable divided by a change in effector. That is, the sensitivities are calculated as the rate of change of each variable per change in effector. This is done as follows. When the effector, such as spark advance angle trim, had been moved upward and all the variable values read, and then moved downward and all the variable values read, the total change in variable value divided by the total change in effector trim movement is calculated and the sensitivities are obtained. These sensitivities are stored, and the system proceeds to decision block 438 which checks if all the effectors have been moved. In the present example, only the first effector had been moved (the spark advance angle), and therefore decision block 438 output is negative. The system continues with the next effector (block 440) and enters decision block 408. It is thus seen that the sensitivity of the second effector is calculated and the system proceeds in the manner described with respect to the first effector until the determination of decision block 438 is affirmative. That is, when all of the sensitivities had been calculated, the system then proceeds to block 442.

At decision block 442, the distance that each effector and engine variable are away from their limits are calculated, and the sensitivities of each variable are stored in system memory in the form of a simplex matrix. That is, by calculating all of the sensitivities of each variable per change in engine effector, a series of partial differential equations can be represented in matrix form, wherein the first column of the matrix includes the partials of each change in variable per change in first effector, and the second column is the partial of each change in variable per change in second effector. A representation of the sensitivity matrix 500 is shown in FIG. 13.

From block 442, the system proceeds to block 444 where the simplex method or algorithm is solved to optimize a particular variable. The simplex algorithm is a well known algorithm whereby a series of simultaneous linear equations can be solved to optimize one of the variables. In the present case, the BSFC is desired to be minimized. The simplex algorithm, as is well known to those of skill in the art, solves the set of equations, by an iterative technique, so that the BSFC is minimized. In essence, the decision block 444 solves the matrix equation shown in FIG. 13 to obtain values for moving one or both of the effectors a certain magnitude and direction to minimize BSFC.

With reference to FIG. 13, it should be appreciated that after the sensitivities of each variable are calculated, the sensitivity matrix 500 will be filled with real numbers in the first two columns. The first column represents the calculated sensitivities of each variable (s.a., d.k.l., a.p., m.p., and BSFC) with respect to a change in the spark angle trim ($\Delta_s$ s.a.t.). The second column represents the calculated sensitivities of each of the five variables with respect to a change in the air manifold pressure trim ($\Delta_s$ m.p.t.). The top row of the matrix represents the function to be optimized; in this case, the BSFC is to be minimized which is represented by a −1 in the last column of the first row. The remaining positions of the rows and columns are filled with −1's and 0's, as shown.

The above sensitivity matrix 500 is multiplied by a column vector 502 representing all of the variables. When the matrix multiplication is carried out, a series of linear equations are obtained as follows:

$$-\Delta_d\, BSFC = \text{value to be minimized}$$
$$S_1\, \Delta_d\, s.a.t. + S_2\, \Delta_d\, m.p.t. - \Delta_d\, s.a. = 0$$
$$S_3\, \Delta_d\, s.a.t. + S_4\, \Delta_d\, m.p.t. - \Delta_d\, d.k.l. = 0$$
$$S_5\, \Delta_d\, s.a.t. + S_6\, \Delta_d\, m.p.t. - \Delta_d\, a.p. = 0$$
$$S_7\, \Delta_d\, s.a.t. + S_8\, \Delta_d\, m.p.t. - \Delta_d\, m.p. = 0$$
$$S_9\, \Delta_d\, s.a.t. + S_{10}\, \Delta_d\, m.p.t. - \Delta_d\, BSFC = 0$$

Where $S_1$ through $S_{10}$ are the various sensitivity values obtained. The topmost equation indicates that the BSFC is to be minimized, and is not further considered. The remaining five equations include seven variables. These equations are solved by the conventional simplex method whereby the values for $\Delta_d$ s.a.t. and $\Delta_d$ m.p.t. are calculated so as to obtain the lowest value of $\Delta_d$ BSFC, while keeping all variables within their predetermined limits. For example, the spark angle trim can be changed only plus or minus 2°, the manifold pressure trim plus or minus 1 in. Hg., in the preferred embodiment. The remaining variables can be changed only within their predetermined operating limits. By knowing these limits, stored in memory, the above equations can be solved for $\Delta_d$ s.a.t. and $\Delta_d$ m.p.t. that will minimize the BSFC variable. The simplex method of solution is well-known. See, for example, the text, "Design of Linear Systems", by W. F. Stoecker, Chapter 11 ("Linear Programming"), pp. 196–226, McGraw-Hill, 1971. The simplex algorithm is readily implemented by conventional programming techniques.

Following the implementation of the simplex method of solution (block 444), the system requests the engine control to move the two effectors simultaneously so that the effectors are moved a certain magnitude and direction by vector algebra. The maximum amount of movement of each effector is a full trim step. Essentially, the simplex solution will provide trim values to the closed-loop engine control to move or trim the spark angle a calculated magnitude in either an upward or downward direction and to move or trim the air manifold pressure a calculated amount in either its upward or downward direction (block 446). The system proceeds to decision block 448 and ultimately returns back to FIG. 1, block 104, where the control is actuated to make the calculated movement.

After the movement of the effectors, the system then proceeds through the STL PREP routine and to the SENTRY routine. The SENTRY routine will proceed to decision block 316 which, as discussed above, asks if the new point is better than the prior point. That is, has the BSFC actually improved by the movement of the two effectors? If it has, the SENTRY routine proceeds through the path of blocks 318–324. If the new point is not better, the SENTRY routine proceeds to decision block 328 and calls the MIN routine (block 330). Upon entering the MIN routine, at decision block 400, the system will proceed to decision block 424 whose determination will now be negative. That is, the system is no longer moving the effectors to get the sensitivities. The system will then proceed to decision block 450 which checks a flag representing if the results of a requested effector movement are to be checked. The first time through this decision block 450. the flag will be set so that an affirmative determination is made. (This flag changes to a "no" state upon each pass through block 456; the flag is set to "yes" when the system proceeds through block 454.) The system then checks if any variable exceeded its limit (decision block 452) as a result of the effector movement. That is, the system reads the variable values and determines if any variable is outside of its operating limits. If the limits have not been exceeded, the system proceeds to decision block 453 which asks if the change in the effectors helped, i.e., is the BSFC less than what it was previously. (This is a check similar to decision block 316 of the SENTRY routine.) If the determination of decision block 453 is "yes", the system saves the current operating conditions, i.e., remembers the best point (block 454) and proceeds to block 406 to again move the first effector. Thus, the MIN routine proceeds to calculate new sensitivities and to calculate a new vector value for moving the effectors in a direction to minimize BSFC.

In second and subsequent passes through the MIN routine, the decision blocks 408 and 430 require a checking of the previous variable sensitivities in order to estimate if a change in effector value can be made without a limit being exceeded. If, for example, the first effector cannot be moved up without exceeding a limit, the determination of decision block 408 is negative and the system proceeds to determine if that effector can be moved down without exceeding a limit. It should be apparent, for the present application, that a single effector must be capable of movement either upward or downward.

The MIN routine will proceed to update the sensitivities of the variables, compute the effector movement vector in accordance with the minimization of BSFC, and request the engine control to move the effectors in a direction to so minimize. This will continue until the SENTRY routine determines that no improvement in BSFC is obtainable (decision block 316) for three consecutive passes (decision block 328).

Following the movement of the effectors in a calculated vector direction, if a limit of any variable was exceeded as a result of such movement (output of decision block 452 being "yes"), the system will proceed to block 456 which immediately requests the engine control to move the effectors back to their previous "within limit" positions. In addition, block 456 decreases the percentage of the trim value. Specifically, the trim value is reduced to one-half its previous value. The system then returns (block 458) and the engine control moves the effectors back. The system then proceeds through STL PREP, and through the SENTRY routine and again enters the MIN routine at 400. The system passes through the various decision blocks of the MIN routine to decision block 450 which checks a flag to determine if the system is in the process of checking the results of a requested effector movement. This flag will now be set "no", and the current conditions are saved (block 454). The system then proceeds to move the effectors to obtain a new sensitivity matrix. The effectors will ultimately be moved in a calculated vector direction, but by one-half of the previous trim value.

In the event the MIN routine reaches decision block 452 and it is determined that limits are not exceeded, the system proceeds to decision block 453 and checks if the change in the effectors helped, i.e., minimized BSFC. If this determination is negative, the system proceeds to block 456 where the trim values are reduced by a predetermined percentage. If this decision is affirmative, the system proceeds to block 454 and then to block 406 to begin calculation of the new sensitivities. Upon an affirmative determination from block 453, the trim values are restored to 100% of their full values.

Whenever the SENTRY flag is set (decision block 314 of the SENTRY routing affirmative), the MIN routine will be called again only if the decision block 354 determination is affirmative, i.e., if the engine has moved out of limits or the variables have moved beyond their predetermined values, etc. When the MIN routine is called (at block 330), the MIN routine proceeds as follows. The MIN routine is entered at block 400 and proceeds to decision block 450 where the checking flag will be set to a state such that the output of decision block 450 is affirmative. Decision block 452 then determines if the limits have been exceeded. If the limits have been exceeded, the output will be affirmative and the engine control is then requested (block 456) to move the effectors back to their previous within limit position. If the limits have not been exceeded, but the variables had moved or drifted beyond their predetermined values, the output of block 452 will be negative and the system will proceed to block 453, which had been previously set to have a "yes" output. In either case, the SENTRY flag will be off and the overall SENTRY and MIN routines begin anew to calculate new engine variable sensitivities, etc. That is, a new minimum BSFC is now sought.

In summary, the function of the MIN routine is as follows. First, the MIN routine checks to see if the effectors can be moved in an upward and downward direction to calculate the engine sensitivities. If they can be so moved, they are in fact moved and the variable sensitivities are calculated. From these sensitivities, the movement of the effectors in a given vector direction is determined and the effectors are moved in a direction to minimize BSFC. Following such movement, the variables are checked to see if any limits have been violated, or to see if the movement did, in fact, lower the BSFC. If limits were exceeded or the change did not minimize BSFC, the effectors are moved back to their prior within limit position and the sensitivities are again calculated, but the effectors moved only one-half of the previous values. This process is repeated until SENTRY determines that no improvement in BSFC was obtained over three consecutive attempts. At this point, the SENTRY takes over and monitors the engine conditions until the engine moves out of limits or the variables change by predetermined values, in which case the SENTRY routine calls the MIN routine. If the engine had moved out of limits, the effectors are moved back to a "safe" position, i.e., within the various engine limits. Once safely within engine limits, a new minimum BSFC is calculated.

It should be appreciated that the STL system of the present invention can be applied to any closed-loop engine control system whereby at least one of a plurality of engine variables may be optimized by selectively controlling predetermined engine effectors. The STL system can be an adjunct to any closed-loop control system whereby STL trim values are added to the control loop equations to move the effectors in accordance with the derived trim values. For example, the STL system can be applied to a closed-loop control system for a turbine engine, whereby various turbine engine variables are operated upon and the turbine nozzle vanes and compressor vanes are controlled to minimize fuel consumption.

We claim:

1. A method of minimizing at least one of a plurality of engine variables derived from engine sensors operatively connected with the engine by selectively controlling at least two engine effectors, said method comprising the steps of:

(a) detecting the engine variables and controlling the engine effecters so as to place the engine in an initial operating condition such that the engine variables are within predetermined initial ranges;

(b) (1) controlling the engine effecters so as to place the engine in an optimum operating condition such that one of the plurality of engine variables is minimized and all of the engine variables are within predetermined operating limits, (2) determining the sensitivity of each engine variable to a movement of each effector by calculating the amount of change of each engine variable as a function of a change of each effector, (3) determining the magnitude and direction that each effector can be moved as a function of the sensitivity of each variable so as to minimize the fuel consumption variable, and moving each effector in accordance with said determination, (4) repeating steps (2) and (3) until no further minimization of the fuel consumption variable can be obtained;

(c) reading the engine variables and checking if any of the engine variables have moved greater than a predetermined amount after the engine has been placed in its optimum operating condition; and (d) controlling the engine effecters so as to place the engine in a new optimum operating condition if step (c) is affirmative.

2. The method of claim 1 further comprising the step of:

(e) reading the engine variables and checking if any of the variables has moved outside its predetermined operating limits after the engine has been placed in its optimum operating condition.

3. The method of claim 2 further comprising the step of:

(f) controlling the engine effectors such that all engine variables are within their predetermined operating limits if step (e) is affirmative.

4. The method of claim 1 wherein said controlling step (b) comprises the step of placing the engine in an optimum operating condition such that the engine fuel consumption variable is minimized.

5. The method of claim 1 wherein said step (b)(2) includes the step of determining the magnitude and direction that each effector can be moved in accordance with the simplex algorithmic method of solution.

6. The method of claim 1 wherein said step (b)(1) includes the steps of;

moving one effector an incremental value in a first direction and reading the value of each variable, moving said one effector an incremental value in a second direction and reading the value of each variable, and calculating the amount of change of each variable per unit of effector change;

moving a second effector an incremental value in a first direction and reading the value of each variable, moving the second effector an incremental value in a second direction and reading the value of each variable, and calculating the amount of change of each variable per unit of second effector change.

7. The method of claim 6 wherein said step (b)(1) further includes the step of determining if the operating limit of each variable will be exceeded as a result of movement of an effector, and inhibiting an effector movement if the determination is affirmative.

8. In an electronic engine controller for controlling a reciprocating engine wherein the engine controller is operatively connected with a plurality of engine sensors for detecting various engine variables, including the specific fuel consumption of the engine, and operatively connected with a plurality of engine effectors for selectively moving the effectors to control the operating characteristic of the reciprocating engine, said engine effectors including a spark advance angle effector and an air manifold pressure effector, a method comprising the steps of:

(a) detecting the engine variables and controlling the engine effectors to place the engine in an initial operating condition such that the spark advance angle effector and the air manifold pressure effector can be incremented and decremented by predetermined trim values without violating any operating limit of the engine;

(b) determining the sensitivity of each engine variable to a change in spark advance angle;

(c) determining the sensitivity of each engine variable to a change in air manifold pressure;

(d) determining the magnitude and direction that the spark advance angle and the air manifold pressure can be moved as a function of the sensitivities of the engine variables so as to minimize the specific fuel consumption of the engine;

(e) actuating at least one of the spark advance angle effector and air manifold pressure effector to move the respective spark advance angle and air manifold pressure a magnitude and direction in accordance with the determining step (d); and (f) repeating steps (b) through (e) until no further decrease in specific fuel consumption is obtained.

9. The method of claim 8 further comprising the step of checking the engine variables after the actuating step (e) to determine if any engine variable exceeded a predetermined operating limit and, if affirmative, controlling the effectors such that all engine variables are within their operating limits.

10. The method of claim 8 wherein said determining step (b) includes the steps of, moving the spark advance angle a predetermined trim value in one direction and reading the engine variables;

moving the spark advance angle a predetermined trim value in an opposite direction and reading the engine variables; and determining the amount of change of each engine variable per unit of spark advance angle change.

11. The method of claim 10 wherein the determining step (b) further includes the steps of determining whether the spark advance angle can be moved a predetermined trim value without violating any operating limits of the engine variables, and moving the spark advance angle only if such determination is affirmative.

12. The method of claim 8 wherein said determining step (c) includes the steps of, moving the air manifold pressure a predetermined trim value in one direction and reading the engine variables;

moving the air manifold pressure a predetermined trim value in an opposite direetion nd reading the engine variables; and determining the amount of change of each engine variable per unit of air manifold pressure change.

13. The method of claim 12 wherein the determining step (c) further includes the steps of determining whether the air manifold pressure can be moved a predetermined trim value without violating any operating limits of the engine variables, and moving the air manifold pressure only if such determination is affirmative.

14. An electronic control system for optimizing the operating characteristics of an engine, comprising:

(a) engine variable detecting means for detecting a plurality of engine variables;

(b) engine effector control means for selectively controlling a plurality of engine effectors in response to effector control signals;

(c) computer means operably connected with said engine variable detecting means and said engine effector control means for storing predetermined operating limits of the engine variables, for determining the sensitivity of each engine variable to a change in each engine effector, for determining the magnitude and direction that the engine effectors can be moved, without violating any predetermined operating limits of the engine variables, so as to optimize at least one of said engine variables, and for providing effector control signals to said engine effector control means for moving said engine effectors.

15. An electronic control system as claimed in claim 14 wherein said engine effector control means includes a closed-loop engine control means.

* * * * *